US007493073B2

(12) United States Patent
Kakishima et al.

(10) Patent No.: US 7,493,073 B2
(45) Date of Patent: Feb. 17, 2009

(54) IMAGE FORMING APPARATUS

(75) Inventors: Aya Kakishima, Kanagawa (JP); Yasushi Nagata, Kanagawa (JP); Yasuyuki Kobayashi, Kanagawa (JP); Tatsunori Izawa, Kanagawa (JP); Junpei Amano, Kanagawa (JP); Toru Inoue, Kanagawa (JP); Tetsuo Yamada, Kanagawa (JP); Atsumi Kurita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 184 days.

(21) Appl. No.: 11/349,073

(22) Filed: Feb. 8, 2006

(65) Prior Publication Data

US 2007/0048037 A1 Mar. 1, 2007

(30) Foreign Application Priority Data

Aug. 23, 2005 (JP) ..... 2005-241467

(51) Int. Cl.
*G03G 15/20* (2006.01)

(52) U.S. Cl. ..... 399/327; 399/43; 399/49

(58) Field of Classification Search ..... 399/43, 399/49, 327; 101/483
See application file for complete search history.

(56) References Cited

U.S. PATENT DOCUMENTS 5,865,121 A * 2/1999 Testardi et al. ..... 101/483
6,173,150 B1 * 1/2001 Suzuki et al. ..... 399/315
6,868,240 B2 * 3/2005 Ozawa et al. ..... 399/43

FOREIGN PATENT DOCUMENTS

JP 2003076200 A * 3/2003
JP A 2003-76200 3/2003

* cited by examiner

*Primary Examiner*—David M Gray
*Assistant Examiner*—Ryan D Walsh
(74) *Attorney, Agent, or Firm*—Morgan, Lewis & Bockius LLP

(57) ABSTRACT

An image forming apparatus includes an image forming section which transfers toner onto a latent image due to a difference of electrostatic potential to form a toner image, a transfer section which transfers the toner image onto a recording material directly or via an intermediate transfer body, a fixing section which passes the recording material carrying the toner image between a fixing rotation body and a pressurizing member contacted and pressed each other, and heats and pressurizes to fix the toner image, and a paper dust amount measuring section which measures an amount of paper dust adhering to the recording material. The image forming section forms an image pattern with high toner area coverage at a predetermined interval based on the measured amount of paper dust, and the fixing section fixes the image pattern with the high toner area coverage transferred onto a recording material.

3 Claims, 8 Drawing Sheets

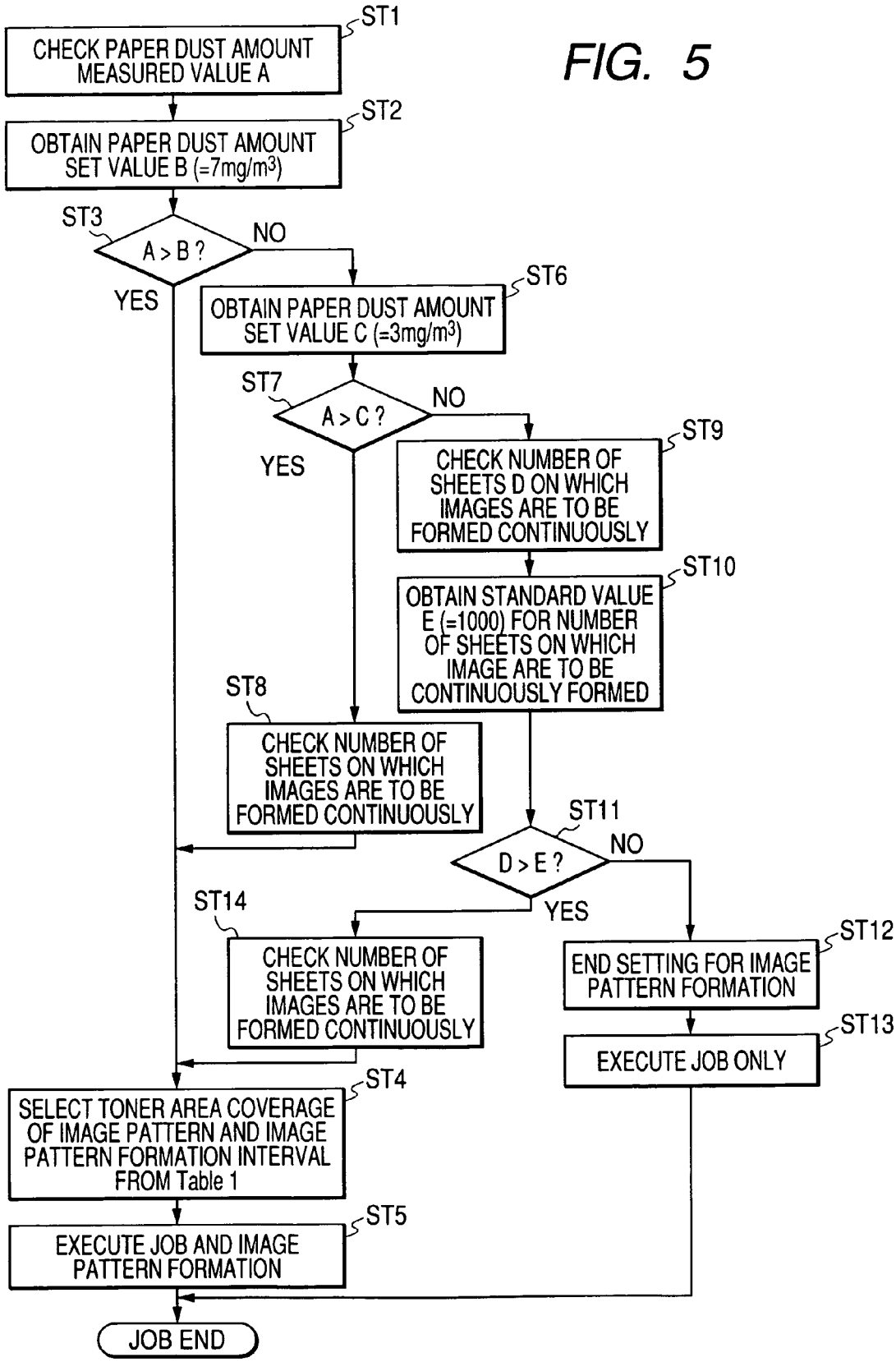
FIG. 5
ST1
CHECK PAPER DUST AMOUNT MEASURED VALUE A
ST2
OBTAIN PAPER DUST AMOUNT SET VALUE B (=7mg/m3)
ST3
A > B ?
NO
YES
ST6
OBTAIN PAPER DUST AMOUNT SET VALUE C (=3mg/m3)
ST7
A > C ?
NO
YES
ST9
CHECK NUMBER OF SHEETS D ON WHICH IMAGES ARE TO BE FORMED CONTINUOUSLY
ST10
OBTAIN STANDARD VALUE E (=1000) FOR NUMBER OF SHEETS ON WHICH IMAGE ARE TO BE CONTINUOUSLY FORMED
ST8
CHECK NUMBER OF SHEETS ON WHICH IMAGES ARE TO BE FORMED CONTINUOUSLY
ST11
D > E ?
NO
YES
ST14
CHECK NUMBER OF SHEETS ON WHICH IMAGES ARE TO BE FORMED CONTINUOUSLY
ST12
END SETTING FOR IMAGE PATTERN FORMATION
ST13
EXECUTE JOB ONLY
ST4
SELECT TONER AREA COVERAGE OF IMAGE PATTERN AND IMAGE PATTERN FORMATION INTERVAL FROM Table 1
ST5
EXECUTE JOB AND IMAGE PATTERN FORMATION
JOB END

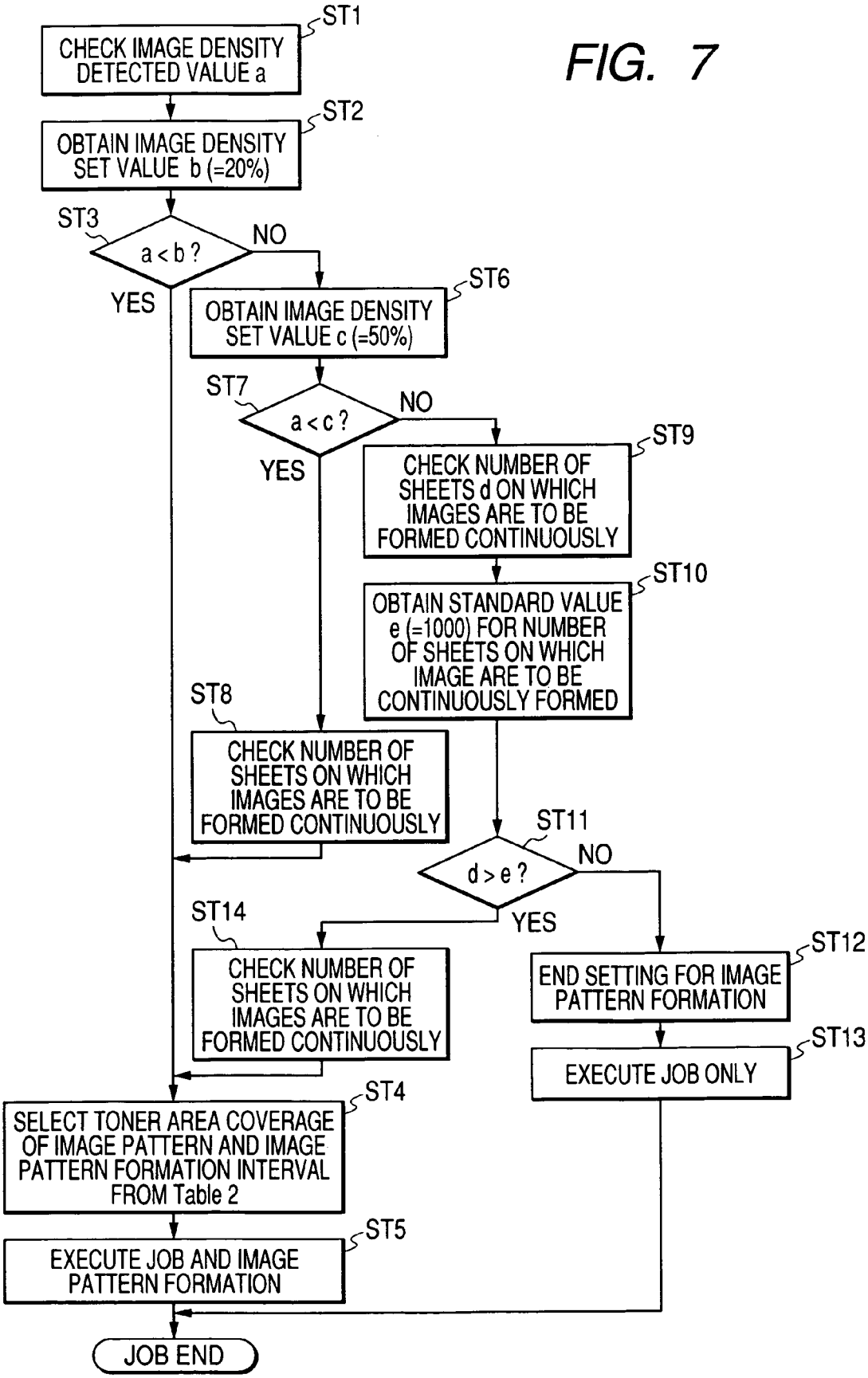
FIG. 7
ST1
CHECK IMAGE DENSITY DETECTED VALUE a
ST2
OBTAIN IMAGE DENSITY SET VALUE b (=20%)
ST3
a < b ?
NO
YES
ST6
OBTAIN IMAGE DENSITY SET VALUE c (=50%)
ST7
a < c ?
NO
YES
ST9
CHECK NUMBER OF SHEETS d ON WHICH IMAGES ARE TO BE FORMED CONTINUOUSLY
ST10
OBTAIN STANDARD VALUE e (=1000) FOR NUMBER OF SHEETS ON WHICH IMAGE ARE TO BE CONTINUOUSLY FORMED
ST8
CHECK NUMBER OF SHEETS ON WHICH IMAGES ARE TO BE FORMED CONTINUOUSLY
ST11
d > e ?
NO
YES
ST14
CHECK NUMBER OF SHEETS ON WHICH IMAGES ARE TO BE FORMED CONTINUOUSLY
ST12
END SETTING FOR IMAGE PATTERN FORMATION
ST13
EXECUTE JOB ONLY
ST4
SELECT TONER AREA COVERAGE OF IMAGE PATTERN AND IMAGE PATTERN FORMATION INTERVAL FROM Table 2
ST5
EXECUTE JOB AND IMAGE PATTERN FORMATION
JOB END

IMAGE FORMING APPARATUS

CROSS-REFERENCE TO RELATED APPLICATIONS

This application is based upon and claims the benefit of priority from the prior Japanese Patent Applications No. 2005-241467, filed on Aug. 23, 2005, the entire contents of which are incorporated herein by reference.

BACKGROUND OF THE INVENTION

1. Field of the Invention

The present invention relates to an image forming apparatus that forms a fixed image by heating and pressurization after toner is selectively attached to a latent image by a difference in electrostatic potential and a toner image is formed and this toner image is transferred to a recording material.

2. Description of the Related Art

A method in which after a toner image is directly transferred on a recording material electrostatically or after a toner image is primarily transferred to an intermediate transfer body and then is secondarily transferred to a recording material, toner including a thermoplastic resin binder is heated and melted and is fixed to the recording material has been widely adopted in a process for fixing a toner image in an image forming apparatus using powdery toner. This heating fixing method is a method in which a recording material on which an unfixed toner image is carried is passed through a nip part in which a pressurizing member and a fixing rotation body having a heating source are contacted and pressed and the toner image is heated and pressurized to perform fixing, and has advantages that fixing can be performed at low electric power and also there is a small danger of ignition due to a paper jam at a fixing part, so that the heating fixing method is widest used.

Such a fixing rotation body has a hollow core of, for example, aluminum and a heater disposed inside the core, and a roll-shaped member etc. whose surface is coated with fluorine resin are used in order to improve release characteristics. Also, a roll-shaped member in which an elastic layer is disposed on a metal core and its surface layer is coated with a fluorine resin tube etc. having good release characteristics is often used as the pressurizing member.

However, when a recording material on which an unfixed toner image is carried passes through a nip part between a pressurizing member and a fixing rotation body, a phenomenon in which toner transfers on a surface of the fixing rotation body, that is, an offset may occur. This offset toner adheres to a recording material next transported and the recording material is stained or a defect in an image is caused.

In order to solve the problem as described above, a roller cleaner is proposed.

Also, an apparatus for applying a voltage between the fixing rotation body and a pressurizing member and forming an electric field so that toner having an electric charge does not transfer to the fixing rotation body is known.

However, as one cause of offsetting toner to a heating rotation body, the fact that paper dust adhering to the fixing rotation body induces an offset was found newly. With this, means for effectively preventing an offset resulting from the paper dust is desired.

In recent years, use of recycled paper has been increasing from the standpoint of forest resources conservation or global environment conservation. Also, use of inferior paper (called "low-cost paper") has been increasing in order to reduce cost of recording materials. The recycled paper or the low-cost paper has a large amount of paper dust adhering in a detachable state and when the recycled paper or the low-cost paper is used in an image forming apparatus, a portion of the paper dust may adhere to the fixing rotation body. Particularly, in the case of fixing an image having many non-image portions in which an image density is low and toner does not transfer, paper dust present in the non-image portions tends to adhere to the fixing rotation body. Then, when a subsequent recording material on which unfixed toner is carried passes through a pressure contact part between the fixing rotation body and a pressurizing member, the unfixed toner transfers to the paper dust adhering to this fixing rotation body and an offset of the toner to the fixing rotation body is caused. That is, the offset of the toner is induced by the paper dust adhering to the fixing rotation body and a stain on an image occurs frequently.

SUMMARY OF THE INVENTION

The invention is achieved based on a causal relationship between the adhesion of paper dust to the heating rotor and the offset of toner, and provide an image forming apparatus in which an offset phenomenon is prevented and there occurs no image defect over the long time, even when the recycled paper or low cost paper is employed as the recording medium.

According to an aspect of the present invention, an image forming apparatus includes an image forming section which transfers toner onto a latent image due to a difference of electrostatic potential to form a toner image a transfer section which transfers the toner image onto a recording material directly or via an intermediate transfer body, a fixing section which passes the recording material on which the toner image is transferred between a fixing rotation body and a pressurizing member contacted and pressed each other, and heats and pressurizes to fix the toner image, and a paper dust amount measuring section which measures an amount of paper dust adhering to the recording material. The image forming section forms an image pattern with high toner area coverage at a predetermined interval based on the amount of paper dust measured by the paper dust amount measuring section, and the fixing section fixes the image pattern with the high toner area coverage transferred onto a recording material.

According to another aspect of the present invention, an image forming apparatus includes an image forming section which transfers toner onto a latent image due to a difference of electrostatic potential to form a toner image, a transfer section which transfers the toner image onto a recording material directly or via an intermediate transfer body, a fixing section which passes the recording material on which the toner image is transferred between a fixing rotation body and a pressurizing member contacted and pressed each other, and heats and pressurizes to fix the toner image, and an image amount detection section which previously detects an amount of an image area where the toner is to be transferred to form the toner image based on input image information. The image forming section forms an image pattern with high toner area coverage at a predetermined interval based on the amount of the image area where the toner is to be transferred detected by the toner amount detection section, and the fixing section fixes the image pattern with the high toner area coverage transferred onto a recording material.

According to another aspect of the present invention, an image forming apparatus includes an image forming section which transfers toner onto a latent image due to a difference of electrostatic potential to form a toner image, a transfer section which transfers the toner image onto a recording material directly or via an intermediate transfer body, a fixing section which passes the recording material on which the toner image is transferred between a fixing rotation body and a pressurizing member contacted and pressed each other, and heats and pressurizes to fix the toner image, a paper dust amount measuring section which measures an amount of paper dust adhering to the recording material, and an image amount detection section which previously detects an amount of an image area where the toner is to be transferred to form the toner image based on input image information. The image forming section forms an image pattern with high toner area coverage at a predetermined interval based on at least any one of the amount of paper dust measured by the paper dust amount measuring section and the amount of the image area where the toner is to be transferred detected by the image amount detection section, and the fixing section fixes the image pattern with the high toner area coverage transferred onto a recording material.

According to still another aspect of the present invention, an image forming apparatus includes an image forming section which transfers toner onto a latent image due to a difference of electrostatic potential to form a toner image, a transfer section which transfers the toner image onto a recording material directly or via an intermediate transfer body, a fixing section which passes the recording material on which the toner image is transferred between a fixing rotation body and a pressurizing member contacted and pressed each other, and heats and pressurizes to fix the toner image, and a paper dust amount estimating section which estimates an amount of paper dust adhering to the fixing rotation body. When the paper dust amount estimating section estimates that the adhering amount of paper dust is a predetermined amount or more, a control is performed so as to inhibit formation of an image with a low toner area coverage or give a warning to the effect that there is a possibility of causing a defect in an image, with respect to an output of the image with the low toner area coverage among subsequent image formation jobs.

According to still another aspect of the present invention, an image forming apparatus includes an image forming section which transfers toner onto a latent image due to a difference of electrostatic potential to form a toner image, a transfer section which transfers the toner image onto a recording material directly or via an intermediate transfer body, a fixing section which passes the recording material on which the toner image is transferred between a fixing rotation body and a pressurizing rotation body contacted and pressed each other, and heats and pressurizes to fix the toner image, and a paper dust amount estimating section which estimates an amount of paper dust adhering to the fixing rotation body. When the paper dust amount estimating section estimates that the adhering amount of paper dust is a predetermined amount or more, a setting is made to preferentially form an image with high toner area coverage among subsequent image formation jobs.

BRIEF DESCRIPTION OF THE DRAWINGS

FIG. 5 is a flowchart showing an operation of outputting a high density image based on a paper dust amount measured value in the image forming apparatus shown in FIG. 1;

FIG. 7 is a flowchart showing an operation of outputting a high density image in the image forming apparatus shown in FIG. 6;

DETAILED DESCRIPTION OF THE EMBODIMENTS

Embodiments of the present invention will be described below based on the drawings.

Figure 1:
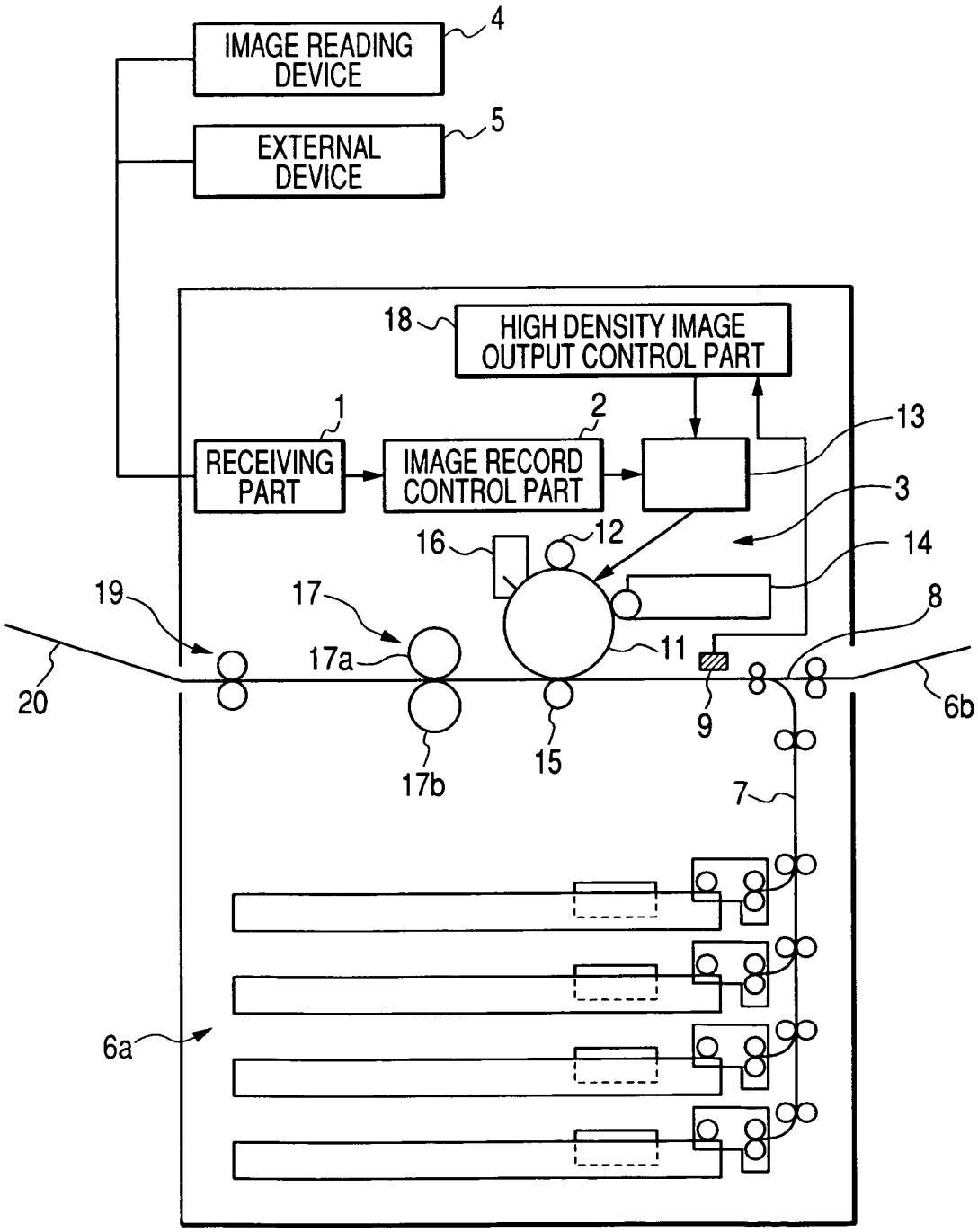
FIG. 1 is a schematic configuration diagram showing an image forming apparatus which is a first exemplary embodiment of the invention according to the present application.

FIG. 1 is a schematic configuration diagram of an image forming apparatus which is one exemplary embodiment of the invention according to the present application.

This image forming apparatus has a receiving part 1 connected to an image reading device 4 and an external device 5 such as a personal computer through a communication line, an image recording control part 2 for performing image processing etc. based on image information inputted to this receiving part 1, and an image forming part 3 for forming an image based on a digital image signal outputted from this image recording control part 2.

A sheet supply part 6*a* for supplying a recording sheet to the image forming part 3 one by one is disposed in a lower portion of the image forming part 3. Also, a manual sheet supply part 6*b* capable of manually supplying a recording sheet from the outside is disposed in a side portion. Then, a first sheet transport path 7 for feeding a recording sheet from the sheet supply part 6*a* to the image forming part 3 and a second sheet transport path 8 for feeding a recording sheet from the manual sheet supply part 6*b* to the image forming part 3 are disposed, and join at the upstream side of a position in which a toner image formed in the image forming part 3 is transferred.

In the downstream side of a position in which the sheet transport paths 7, 8 join, a paper dust amount measuring device 9 is installed to face the sheet transport paths and it is configured to measure the amount of paper dust adhering to the recording sheet in a detachable state and send information to a high density image output control part 18. Then, the recording sheet passing through a position facing this paper dust amount measuring device 9 is fed to the image forming part 3.

Also, a fixing device 17 for heating a toner image on a recording sheet and fixing the toner image to the recording sheet is disposed downstream of the image forming part 3. Then, a paper exit roller 19 for outputting the recording sheet out of the apparatus is disposed downstream of the fixing device 17 and it is configured so that this paper exit roller 19 transports the recording sheet to a paper exit tray 20.

The image forming part 3 has a cylindrical photoconductor drum 11 and a charging device 12 for uniformly charging the surface of the photoconductor drum 11. In the circumference of this photoconductor drum 11, an exposure device 13 for applying the imaging light to the uniformly charged photoconductor drum 11 to form a latent image in a different electrostatic potential on the surface, a developing device 14 for selectively transferring toner to the latent image on the photoconductor drum and forming a toner image, a transfer device 15 for transferring the toner image formed on the photoconductor drum 11 to a recording sheet, and a cleaning device 16 for photoconductor drum for removing the toner remaining on the photoconductor drum 11 after the toner image is transferred.

As the photoconductor drum 11, a photoconductor drum in which a photoconductor layer made of various inorganic photoconductive materials such as Se, a-Si, a-SiC or Cds, organic photoconductive materials, amorphous selenium series photoconductive materials, amorphous silicon series photoconductive materials, etc. is formed on a surface of a metal drum can be used.

The charging device 12 is a device in which a roll of metal such as stainless steel or aluminum having conductivity is coated with a high-resistance material, and is configured to contact the photoconductor drum 11 and is driven by the rotation of the photoconductor drum 11. Then, by applying a predetermined voltage, continuous discharge is generated inside a minute gap in the vicinity of a portion of contact between the roll and the photoconductor drum 11 and the surface of the photoconductor drum 11 is charged almost uniformly.

The exposure device 13 flashes laser light for every pixel based on an image signal and performs exposing and scanning of a circumferential surface of the photoconductor drum 11 by a polygon mirror. By this device, potential of an exposure part attenuates on the circumferential surface of the photoconductor drum 11 and a latent image by a difference in electrostatic potential is formed.

The developing device 14 forms a visible image by transferring toner to a latent image inside an electric field generated in a position near to and facing the photoconductor drum 11.

Figure 2:
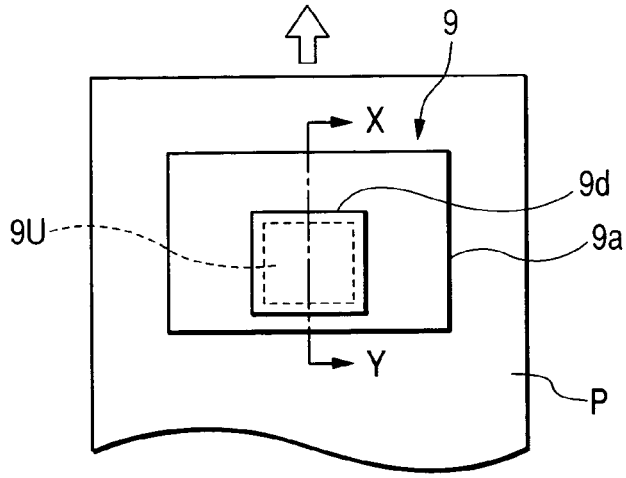
FIG. 2 is a schematic plan view of a paper dust amount measuring device used in the image forming apparatus shown in FIG. 1.
Figure 3:
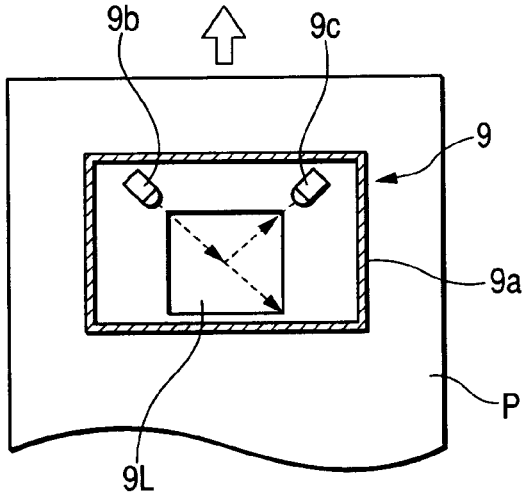
FIG. 3 is a plan sectional view of the paper dust amount measuring device shown in FIG. 2.
Figure 4:
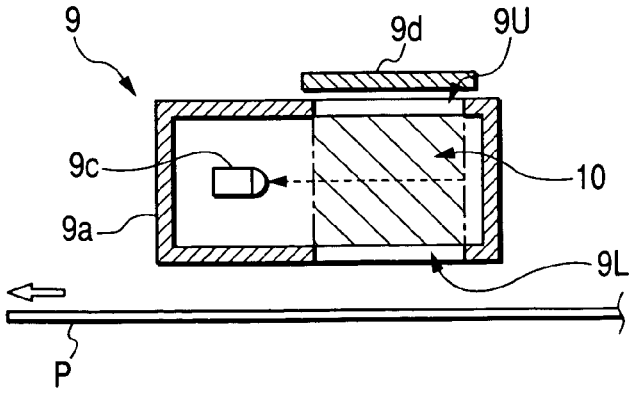
FIG. 4 is a sectional view taken on line X-Y shown in FIG. 2.
Figure 6:
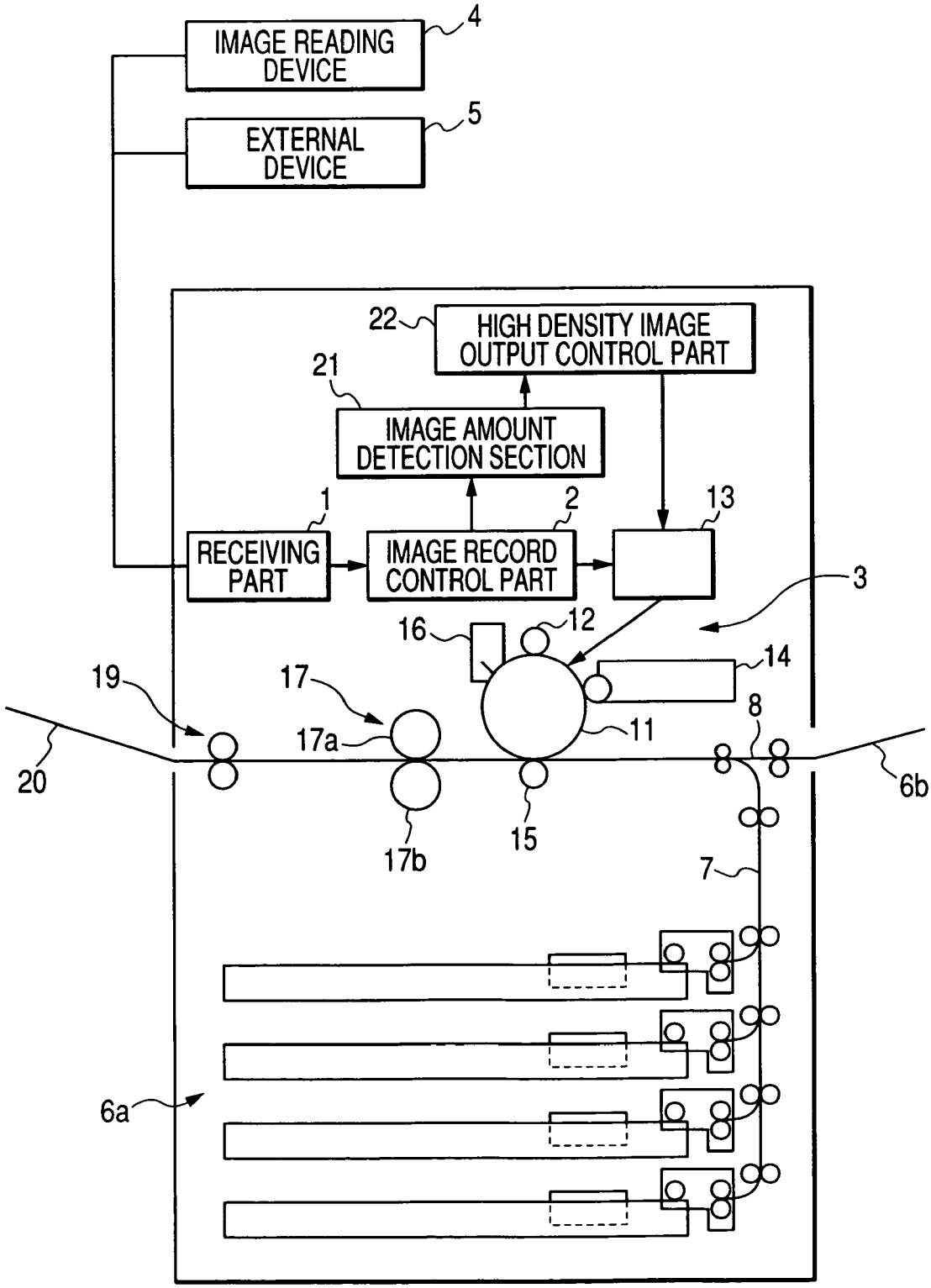
FIG. 6 is a schematic configuration diagram showing an image forming apparatus which is a second exemplary embodiment of the invention according to the present application.

FIG. 2 is a plan view of the paper dust amount measuring device 9, and FIG. 3 is a horizontal sectional view of the paper dust amount measuring device 9, and FIG. 4 is a vertical sectional view taken on line X-Y shown in FIG. 2.

This paper dust amount measuring device 9 has an LED (light emitting diode) 9*b* and a phototransistor (light receiving element) 9*c* inside a cabinet 9*a*, and openings 9U and 9L for measurement are respectively disposed in an upper surface and a lower surface of the cabinet 9*a*. Then, an electrode 9*d* is installed in an upper portion of the opening 9U for measurement of the upper surface, and paper dust on a recording sheet passing below the paper dust amount measuring device 9 is sucked up by this electrode 9*d*. Light generated by the LED 9*b* is applied to measurement space 10 between the openings 9U and 9L for measurement, and illuminates the paper dust of the inside of the measurement space 10, and results in scattered light. The phototransistor 9*c* is arranged in a position in which this scattered light can be sensed, and receives the scattered light. The amount of light received by the phototransistor 9*c* is proportional to the amount of paper dust present inside the measurement space 10, that is, the amount of paper dust sucked up from the recording sheet. The amount of received light of the phototransistor 9*c* is read in the high density image output control part 18 as a voltage signal.

The fixing device 17 has a heating roll 17*a* (fixing rotation body) into which a halogen heater is built, and a pressurizing roll 17*b* (pressurizing member) contacted and pressed to this heating roll, and these rolls are parallel arranged to form a nip part contacted and pressed each other. The recording sheet to which a toner image is transferred is fed to the nip part and is heated and pressurized between the heating roll 17*a* and the pressurizing roll 17*b* driven to rotate, and the melted toner is fixed on the recording sheet.

In the embodiment, an outside diameter of the heating roll 17*a* is 65 mm. Also, a surface layer of the pressurizing roll 17*b* is formed of rubber etc. and an outside diameter is 65 mm.

Next, an operation of the image forming apparatus will be described.

A recording sheet used as a recording medium for forming an image is selected based on image information inputted from the image reading device 4 or external device 5, or a signal inputted by an operator. When a recording sheet accommodated in the sheet supply part 6*a* is selected as a recording material, the recording sheet is sequentially drawn out of a sheet tray one by one and is transported toward the image forming part 3 on the first sheet transport path 7 by a transport roller. On the other hand, when paper feeding from the manual sheet supply part 6*b* is selected, the recording sheet placed in a manual tray is sequentially drawn one by one and is transported to the image forming part 3 through the second sheet transport path 8. Then, the two transport paths 7, 8 join at the upstream side of a position in which an image is transferred.

The paper dust amount measuring device 9 disposed downstream of a position in which the sheet transport paths 7, 8 join induces paper dust adhering to the transported recording sheet in a detachable state inside the measurement space 10 by an electric field formed between the electrode 9*d* and the recording sheet, and measures the amount of paper dust as a paper dust density. Then, the measured paper dust density is sent to the high density image output control part 18 as a voltage signal.

In the image forming part 3, based on an image signal outputted from the image recording control part 2, imaging light is applied from the exposure device 13 to the photoconductor drum 11 and an electrostatic latent image is formed. In a position facing the developing device 14, toner is transferred to this electrostatic latent image and a toner image is formed and this toner image is transferred on the recording sheet fed in good timing to a portion facing the transfer device 15. Then, by passing the recording sheet carrying a toner image through a pressure contact part between the heating roll 17*a* and the pressurizing roll 17*b* of the fixing device 17, heating and pressurization are performed to form a fixed toner image. By the paper exit roller 19, the recording sheet on which the toner image is fixed is transported to the outside of the apparatus.

Also, by repeating outputs of images, paper dust adhering to the recording sheet is transferred to the heating roll 17*a* of the fixing device 17 and at timing set by control described below, an image pattern with high toner area coverage, for example, a solid image, for removing the paper dust is formed. This image pattern is formed in a manner similar to formation of the ordinary toner image and based on a pattern signal stored in the high density image output control part 18 or the image recording control part 2, exposure of the photoconductor drum 11 is performed and transfer to a recording sheet and development by transferring toner to an electrostatic latent image formed are performed. Then, the recording sheet in which the image pattern with high toner area coverage is carried is fed to the fixing device 17 and is pressed on a circumferential surface of the heating roll 17*a*. At this time, the toner is heated and softened and the paper dust adhering to the circumferential surface of the heating roll 17*a* is captured and is removed.

Next, control of forming the image pattern with high toner area coverage will be described based on FIG. 5.

FIG. 5 is a flowchart showing an operation of forming the image pattern with high toner area coverage based on the amount of paper dust. Also, Table 1 shows various set values for concrete control of forming the image pattern with high toner area coverage, and these set values are stored in the high density image output control part 2.

TABLE 1

| | | | | |
|---|---|---|---|---|
| (1) | Paper Dust Amount Set Value | 0-3 mg/m$^3$ | | |
| | The Number of Sheets on which Images are to be Formed | 1000-5000 sheets | 5000 or more sheets | |
| | Toner Area Coverage | 70% | | |
| | Image Pattern Formation Interval | 500 | 250 | |
| (2) | Paper Dust Amount Set Value | 3 to 7 mg/m$^3$ | | |
| | The Number of Sheets on which Images are to be Formed | 0-500 sheets | 500-1000 sheets | 1000 or more sheets |
| | Toner Area Coverage | 80% | | |
| | Image Pattern Formation Interval | 300 | 250 | 150 |
| (3) | Paper Dust Amount Set Value | 7 mg/m$^3$ or more | | |
| | The Number of Sheets on which Images are to be Formed | 1 or more sheets | | |
| | Toner Area Coverage | 100% | | |
| | Image Pattern Formation Interval | 100 | | |

First, a paper dust amount measured value A measured by the paper dust amount measuring device 9 is inputted to the high density image output control part 18 and the paper dust amount measured value A is checked (ST1). Thereafter, a standard set value (hereinafter called "paper dust amount set value") B for controlling the formation of the image pattern with high toner area coverage, that is, the paper dust amount 7 mg/m$^3$ shown in a field (3) of Table 1 is called from data stored in the high density image output control part 18 (ST2). Then, value A of the measured paper dust amount is compared with the paper dust amount set value B (ST3) and when A>B is satisfied, setting for forming the image pattern in which a toner area coverage is 100% every 100 sheets of paper passing through the fixing device 17 is made based on Table 1 (ST4). Then, while toner images are formed on many recording sheets, an image pattern with high toner area coverage is formed every predetermined number of sheets, that is, toner images are formed on 100 sheets (ST5).

When A>B is not satisfied, the paper dust amount measured value A is next compared with the paper dust amount set value C (3 mg/m$^3$) in a field (2) of Table 1 (ST6) (ST7). When A>C (3 mg/m$^3$) is satisfied, the number of sheets on which images are to be formed continuously is checked (ST8) and according to this, a toner area coverage of the image pattern and an interval of forming the image pattern are set from Table 1 (ST4). The number of sheets on which images are to be formed continuously is a value set before an operator starts an image forming operation or a value inputted from an external device together with image information. When the number of sheets on which images are to be continuously formed is 500 or less, an image pattern with toner area coverage of 80% is formed every 300 sheets and when the number of sheets on which images are to be continuously formed is 500 to 1000, the image pattern is formed every 250 sheets and when the number of sheets on which images are to be continuously formed is 1000 or more, the image pattern is formed every 150 sheets.

When A>C (3 mg/m$^3$) is not satisfied, the number D of sheets on which images are to be continuously formed is checked (ST9) and a set value in a field (1) of Table 1, that is, a standard value E for the number of sheets on which images are to be continuously formed is called and compared (ST10) (ST11). Then, when the number D of sheets on which images are to be continuously formed is less than the standard value E (1000 sheets), that is, when D>E=1000 is not satisfied, it is unnecessary to form the image pattern with high toner area coverage and setting is ended (ST12) and a predetermined image formation job is executed without forming the image pattern (ST13). When D>E=1000 is satisfied, the number of sheets on which images are to be formed continuously is checked (ST14) and setting shown in Table 1 is selected (ST4) and a job of forming an image is executed and also the image pattern with high toner area coverage is formed (ST5). That is, when images are to be formed on 1000 to 5000 sheets continuously, an image pattern with toner area coverage of 70% is formed every 500 sheets and when images are to be formed on 5000 or more sheets, the image pattern is formed every 250 sheets.

In this manner, every time operations of fixing and image formation are repeated by the number of sheets set, the image pattern with high toner area coverage is formed on a recording sheet and is passed through the fixing device. As a result of this, paper dust adhering to the heating roll 17*a* of the fixing device 17 is removed properly and a large amount of image formation can be performed in a state in which a stain on an image is not caused.

Next, an image forming apparatus which is a second exemplary embodiment of the invention of the present application will be described.

A configuration of this image forming apparatus is described as the first exemplary embodiment and has the substantially same configuration as the image forming apparatus shown in FIG. 1, but an image amount detection section 21 is disposed instead of the paper dust amount measuring section 9.

This image amount detection section 21 counts an image amount by a video counter based on a digital image signal outputted from an image recording control part 2. Then, a high density image output control part 22 performs control to form image pattern with high toner area coverage in order to remove paper dust on a heating roll 17*a* based on the image amount detected by the image amount detection section 21.

The other configurations such as a receiving part 1, the image recording control part 2, an image forming part 3, a fixing device 17, a sheet supply part 6 of this image forming apparatus are the same as those of the image forming apparatus shown in FIG. 1. Then, in a manner similar to the image forming apparatus shown in FIG. 1, based on a digital image signal, an electrostatic latent image is formed and a toner image is formed and the image is transferred to a recording sheet to perform fixing.

Next, control of outputting a high density image in the image forming apparatus will be described.

FIG. 7 is a flowchart showing an operation of forming an image pattern with high toner area coverage based on a detected image amount, that is, an image density, and Table 2 shows various set values for forming the image pattern with high toner area coverage as one example, and the set values are stored in the high density image output control part 22.

TABLE 2

| | | | | |
|---|---|---|---|---|
| (1) | Image Density | 50-100% | | |
| | The Number of Sheets on which Images are to be Formed | 1000-5000 sheets | 5000 or more sheets | |
| | Toner Area Coverage | 70% | | |
| | Image Pattern Formation Interval | 500 | 250 | |
| (2) | Image Density | 20-50% | | |
| | The Number of Sheets on which | 0-500 | 500-1000 | 1000 or |

TABLE 2-continued

| | Images are to be Formed | sheets | sheets | more sheets |
|---|---|---|---|---|
| | Toner Area Coverage | | 80% | |
| | Image Pattern Formation Interval | 300 | 250 | 150 |
| (3) | Image Density | | 0-20% | |
| | The Number of Sheets on which Images are to be Formed | | 1 or more sheets | |
| | Toner Area Coverage | | 100% | |
| | Image Pattern Formation Interval | | 100 | |

First, the image amount detection section 21 detects an image amount, that is, an image density based on a digital image signal outputted from the image recording control part 2. Then, the detected image density a is inputted to the high density image output control part 22 (ST1). Then, a standard set value (hereinafter called "an image density set value") b for controlling formation of the image pattern with high toner area coverage, that is, a set value 20% of a field (3) shown in Table 2 is read from data stored in the high density image output control part 22 (ST2). Then, the detected image density a is compared with the image density set value b (ST3) and when a<b is satisfied, setting to form the image pattern in which a toner area coverage is 100% every 100 sheets of paper passing through the fixing device 17 is made based on the field (3) of Table 2 (ST4). Then, while a job of image formation is executed, every time images are formed on 100 sheets, an image pattern with high toner area coverage is formed and fixed (ST5).

When a<b is not satisfied, an image density set value c (50%) of a field (2) is read (ST6) and is compared with the detected image density a (ST7). When a<c (50%) is satisfied, the image pattern with high toner area coverage is formed according to the number of sheets on which images are to be formed continuously with reference to the field (2) of Table 2 (ST8) (ST4) (ST5). The number of sheets on which images are to be formed continuously is a value set before an operator starts an image forming operation or a value inputted from an external device together with image information. When the number of sheets on which images are to be formed continuously is 500 or less, an image pattern with toner area coverage of 80% is formed every 300 sheets and when the number of sheets on which images are to be formed continuously is 500 to 1000, the image pattern is formed every 250 sheets and when images are to be formed on 1000 or more sheets continuously, the image pattern is outputted every 150 sheets.

When a<c (50%) is not satisfied, the number d of sheets on which images are to be formed continuously is checked (ST9) and a set value in a field (1) of Table 2, that is, a standard value e for the number of sheets on which images are to be continuously formed is read (ST10). Then, the number d is compared with the set value e (1000 sheets) (ST11) and when d>e=1000 is not satisfied, it is unnecessary to form the image pattern with high toner area coverage and setting is ended (ST12) and a predetermined image formation job is executed without forming the image pattern (ST13). When d>e=1000 is satisfied, the image pattern is formed based on setting shown in the field (1) of Table 2 according to the number of sheets on which images are to be formed continuously (ST14) (ST4) (ST5). That is, when images are to be formed on 1000 to 5000 sheets continuously, an image pattern with toner area coverage of 70% is formed every 500 sheets and when images are to be formed on 5000 or more sheets, the image pattern is formed every 250 sheets.

In this manner, every time operations of fixing and image formation are repeated by the number of sheets set, the image pattern with high toner area coverage is formed on a recording sheet and is passed through the fixing device. As a result of this, paper dust adhering to a heating roll of the fixing device 17 is removed properly and a large amount of image formation can be performed in a state in which a stain on an image is not caused.

Figure 8:
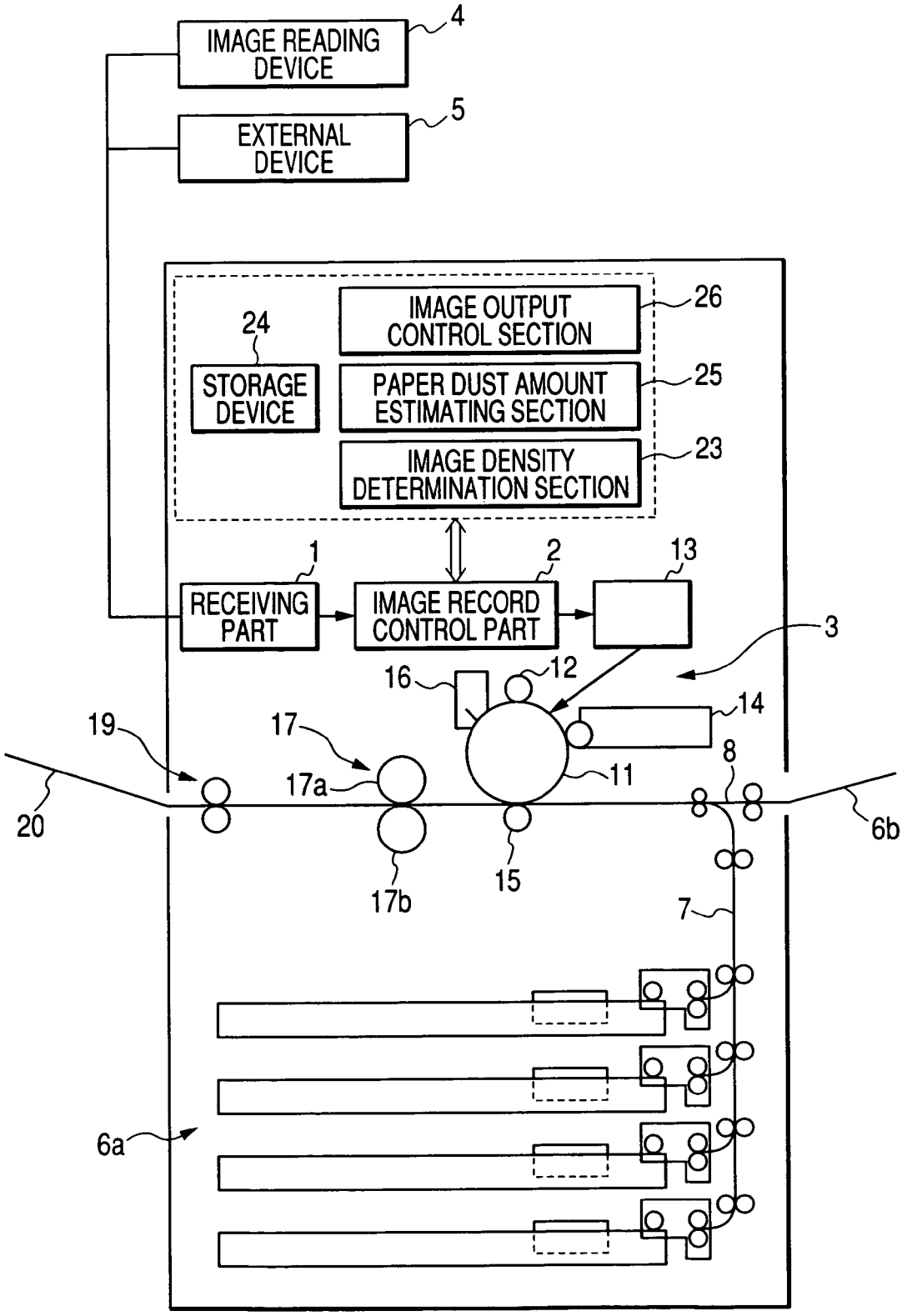
FIG. 8 is a schematic configuration diagram showing an image forming apparatus which is a third embodiment of the invention according to the present application.

Next, a third exemplary embodiment according to the invention of the present application will be described with reference to FIG. 8.

This image forming apparatus has a receiving part 1, an image recording control part 2, an image forming part 3, a fixing device 17 and a sheet supply part 6 similar to those of the image forming apparatus shown in FIG. 1. Then, in a manner similar to the image forming apparatus shown in FIG. 1, based on a digital image signal, an electrostatic latent image is formed and a toner image is formed and the image is transferred to a recording sheet, and then subjected to fixing.

Also, this image forming apparatus has image density determination section 23 for dividing an image into plural portions based on a digital image signal outputted from the image recording control part 2 and determining each of the portions as a high density region, a low density region or a non-image region, a storage device 24 for storing and accumulating determination results by the image density determination section 23 and the digital image signal generated by the image recording control part 2, paper dust amount estimating section 25 for estimating the amount of paper dust on a heating roll 17*a* in the fixing device based on the determination results of the image density, and image output control section 26 for controlling an output of an image based on data stored in the storage device and a calculation result of the paper dust amount estimating section.

Then, this image forming apparatus performs control so that when it is estimated that a large amount of paper dust is accumulated on the heating roll based on an estimation value of the paper dust amount estimating section 25, by the image output control section 26, with respect to an output of a low density image (a toner area coverage is 30% or less) in which a stain tends to be noticeable due to an offset, a warning to the effect that there is a possibility of causing a defect etc. in an image is outputted or an output of the low density image is inhibited or an image with high toner area coverage (a toner area coverage is 70% or more) is preferentially outputted from among subsequent jobs.

That is, in a non-image part region in which toner is not placed on a recording sheet, paper dust tends to transfer to the heating roll 17*a* at the time of passing through the fixing device. Therefore, by cumulating the non-image regions of the recording sheets passed through the fixing device 17, the amount of paper dust adhering to the heating roll 17*a* of the fixing device 17 is estimated and when this cumulative value becomes large, it is estimated that the amount of paper dust adhering increases. Also, when many high density images pass through the fixing device 17, paper dust adheres to toner forming the images and is removed and it is estimated that the amount of paper dust adhering to the heating roll is small. Then, when a large amount of paper dust adheres, a possibility of causing an offset of toner is increased. An operator is informed of such a state by taking measures to give a warning or inhibit an output of a low density image and an output of a stained image is prevented. Also, a stain on a high density image is difficult to be noticeable and further, the high density image has a function of transferring paper dust adhering to the heating roll 17*a* to a toner image and removing the paper dust from a circumferential surface of the heating roll 17*a*. Therefore, when a high density image exists among images to be formed subsequently, occurrence of a stain due to an offset can be prevented by preferentially forming this high density image.

Next, concrete control of the image forming apparatus will be described based on FIGS. 9 and 10.

Figure 9:
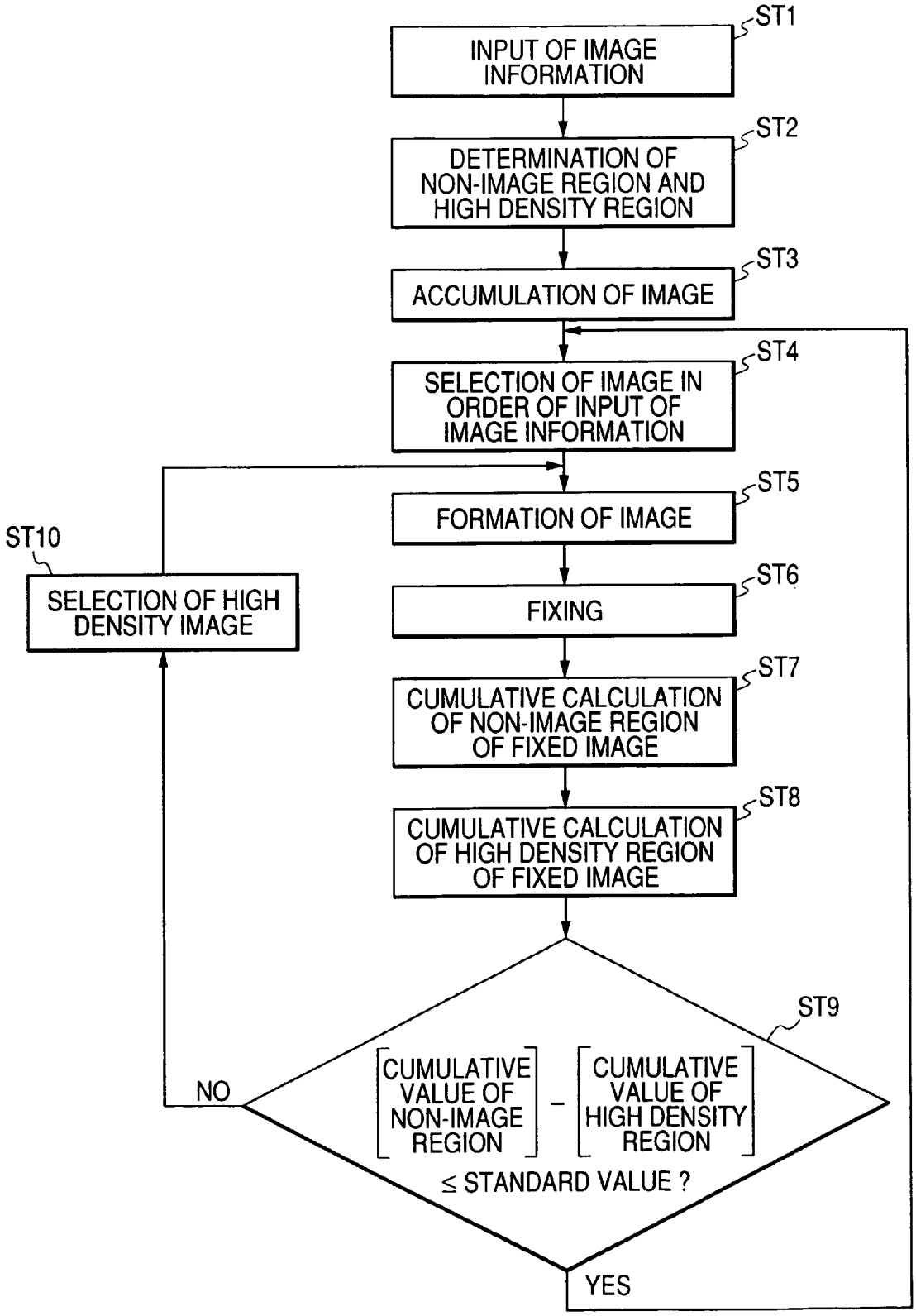
FIG. 9 is a flowchart showing output control of an image in the image forming apparatus shown in FIG. 8.
Figure 10A:
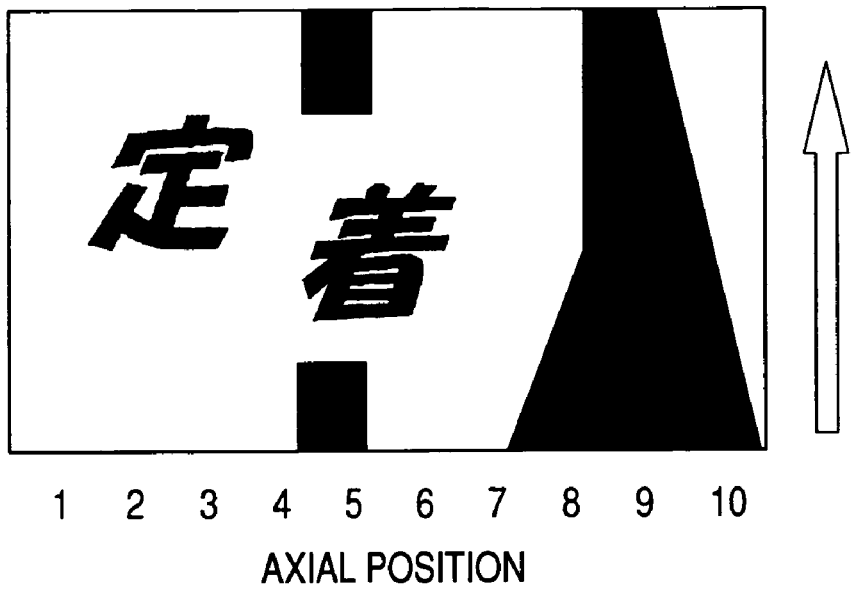
FIGS. 10A and 10B are schematic diagrams showing a method for counting high density regions and non-image regions in the image forming apparatus shown in FIG. 8.
Figure 10B:
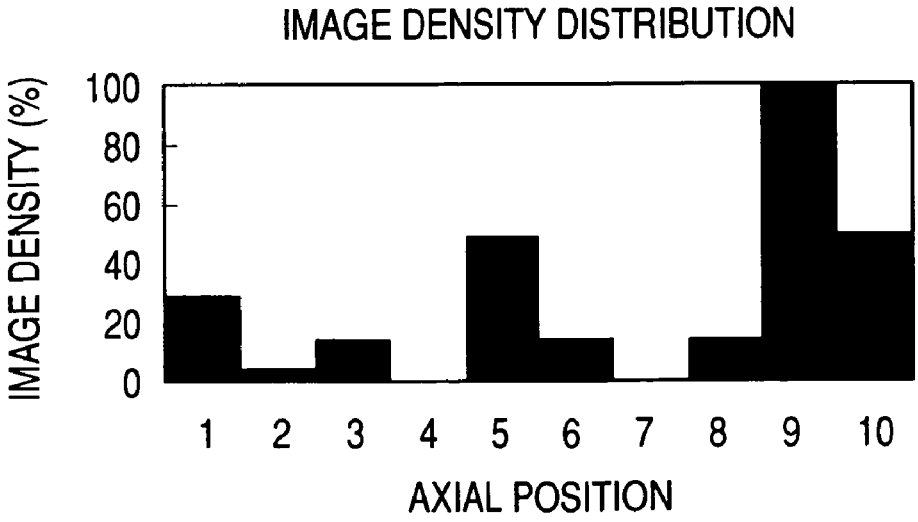

FIG. 9 is a flowchart showing an operation of estimation of the amount of paper dust on the heating roll 17*a* and controlling the image forming apparatus based on the amount of paper dust estimated, and FIGS. 10A and 10B show a method for totaling up cumulative image density values of a high density region and a non-image region.

Image information inputted from the image reading device 4 or external device 5, or a signal inputted by an operator is converted into a digital image signal in the image recording control part 2 (ST1). Then, in the image density determination section 23, high density regions and non-image regions are determined and the image density is counted with respect to each of the images which will be outputted sequentially based on this digital image signal (ST2). A determination result by the image determination section 23 and the digital image signal are stored in the storage device 24 (ST3). Then, formation of images is started in the order that the image information items were inputted (ST4). The image is formed by application of imaging light to a photoconductor drum to form an electrostatic latent image, development of the electrostatic latent image with toner and transfer the toner image to a recording sheet as described above (ST5), and the toner image is fixed to the recording sheet by heating and pressurization (ST6).

After fixing of the toner image or before fixing of the toner image, in the paper dust amount estimating section 25, image density values of high density regions and non-image regions of images are read from the storage device and cumulative calculation is done (ST7) (ST8). Then, a difference between a cumulative image density value of the high density image regions and a cumulative image density value of the non-image regions is calculated and is compared with a preset standard value (ST9). When the difference is smaller than the standard value, it is estimated that paper dust adhering to the heating roll 17*a* of the fixing device is small, and the next image forming operation is performed. On the other hand, when the difference between the cumulative image density value of the high density image regions and the cumulative image density value of the non-image regions becomes larger than the standard value by repeating the image forming operations, it is estimated that the amount of paper dust adhering to the heating roll 17*a* of the fixing device becomes large, and it is in a state in which a stain due to an offset tends to occur. In this case, by the image output control section 26, an image with a high image density is called from image information for subsequent image formation jobs stored in the storage device 24 and the image is preferentially outputted (ST10). By outputting the high density image, paper dust on the heating roll 17*a* is removed and a state of a surface of the heating roll is improved and also the difference between the cumulative image density value of the high density image regions and the cumulative image density value of the non-image regions becomes small.

When there is no high density image to be preferentially outputted in the case where the difference between the cumulative image density value of the high density image regions and the cumulative image density value of the non-image regions becomes larger than the standard value, there is a possibility of causing a stain on a low density image next outputted, and therefore a warning to that effect is outputted to a display device etc. Also, along with this, measures to, for example, stop the image forming operation and inhibit an output of the low density image can be taken.

Calculation of the non-image regions and the high density image regions and calculation of the cumulative image density value are done every image and, for example, one image can be divided into plural regions to do calculation with respect to each of the regions as described below.

As shown in FIGS. 10A and 10B, an image is divided into plural portions by a division line parallel to a process direction at the time of forming an image in a digital image signal. For example, a width of paper is divided into 10 lanes at regular intervals and image densities of non-image regions and high density image regions in each lane are counted and this count is inputted to the storage device.

When an image is transferred to a recording sheet and an operation of fixing this is started, a cumulative image density value of the non-image regions is compared with a cumulative image density value of the high density image regions in each lane from data stored in the storage device 24 with respect to the outputted image and when [the cumulative image density value of the non-image regions−the cumulative image density value of the high density image regions≦a specified value] is satisfied for all the lanes, it is decided that paper dust is removed along with melted and fixed toner since many high density image regions in which many toners are placed have passed, and an offset of toner does not occur. Therefore, the next job is executed as usual in the order that image information items were input.

On the other hand, when [the cumulative image density value of the non-image regions−the cumulative image density value of the high density image regions>the specified value] is satisfied for some lane, it is estimated that a large amount of paper dust adheres to a circumferential surface of the heating roll 17*a* since many non-image regions have passed. When an image in the subsequent job having a low density image region in the corresponding lane is to be outputted in the case of being estimated thus, it is decided that there is a possibility of inducing a toner offset due to paper dust in this lane, and a warning is provided to the effect that there is a possibility of causing a defect in an image or a stain on an image. Or, control may be performed so that an image in the subsequent job having a high density image region in the corresponding lane is preferentially outputted. If there is no subsequent image having a high density image region in the corresponding lane in the corresponding lane, control of inhibiting an output of a low density image in this lane can be performed.

As described so far, according to an aspect of the present invention, an image forming apparatus includes an image forming section which transfers toner onto a latent image due to a difference of electrostatic potential to form a toner image a transfer section which transfers the toner image onto a recording material directly or via an intermediate transfer body, a fixing section which passes the recording material on which the toner image is transferred between a fixing rotation body and a pressurizing member contacted and pressed each other, and heats and pressurizes to fix the toner image, and a paper dust amount measuring section which measures an amount of paper dust adhering to the recording material. The image forming section forms an image pattern with high toner area coverage at a predetermined interval based on the amount of paper dust measured by the paper dust amount measuring section, and the fixing section fixes the image pattern with the high toner area coverage transferred onto a recording material.

In the image forming apparatus, the image pattern with the high toner area coverage, for example, a solid image, is formed at a proper interval and when passing through a nip part of fixing section, toner of the image pattern is pressed on a surface of a fixing rotation body and is heated and softened. At this time, paper dust adhering to the surface of the fixing rotation body adheres to the toner of the image pattern and is removed. Therefore, the surface of the fixing rotation body can be recovered in a state in which the paper dust does not adhere, and an offset can effectively be prevented from occurring in the subsequent fixing processes.

Also, the amount of paper dust on a recording material to be used in image formation is measured and the image pattern with the high toner area coverage is formed according to this detection value, so that formation and fixing of the image pattern with the high toner area coverage are limited to the case where the amount of paper dust adhering to the surface of the fixing rotation body is estimated to increase and the amount of toner and the recording material used for a purpose other than a primary one can be reduced. That is, when the image pattern with the high toner area coverage is formed, the toner and the recording material are consumed in order to remove the paper dust, but this consumed amount can be reduced. The image pattern with the high toner area coverage is formed every small number of sheets of paper passing through the fixing device when the amount of paper dust measured is large and every large number of sheets of paper passing through the fixing device when the amount of paper dust measured is small. Thus, frequency of forming the image pattern with the high toner area coverage is controlled according to the amount of paper dust, so that the toner and the recording material are not consumed more than necessary and the paper dust is effectively removed from the fixing rotation body and an offset of the toner can efficiently be prevented.

On the other hand, this image forming apparatus may have an image amount detection section instead of the paper dust amount measuring section, and a configuration of detecting the amount of an image area to which toner will be transferred can be adopted. Then, an image pattern with high toner area coverage is controlled to be formed at a predetermined interval based on the amount of the image area detected. That is, when an image area to be developed with toner and transferred to a recording material is small, it is considered that a region in which paper dust tends to transfer from the recording material to a fixing rotation body is wide and the amount of paper dust adhering to the fixing rotation body increases. Therefore, by forming and fixing the image pattern with the high toner area coverage at proper timing according to the detected amount of image area, the paper dust can be attached to toner heated and pressurized at a nip part and removed. As a result of this, an offset of the toner induced in the paper dust adhering to the fixing rotation body can efficiently be prevented and also, vain use of the toner and the recording material is eliminated.

The image pattern with the high toner area coverage is not limited to a pattern in which toner is fully transferred to the whole region of an image portion (an toner area coverage is 100%), and the toner area coverage of the image pattern can be set based on the amount of paper dust measured by the paper dust amount measuring section or the amount of the image area detected by the image amount detection section. That is, as the amount of paper dust adhering to a recording material at the time of forming an image is small or an amount of the image area is large, the toner area coverage of the image pattern is decreased and as the amount of paper dust is large or the amount of the image area is small, the toner area coverage of the image pattern is increased. By controlling the toner area coverage of the image pattern thus, the amount of toner used for removing the paper dust is reduced in the case where the amount of paper dust is estimated to be small. As a result of this, the paper dust can properly be removed from a fixing rotation body while consumption of the amount of toner is reduced.

Further, this image pattern with the high toner area coverage is formed with a length longer than or equal to a circumferential length of a fixing rotation body in a transport direction of a recording material and the maximum width of a region in which the fixing rotation body and a toner image are contacted and pressurized. As a result of this, the image pattern is contacted and pressed over the whole circumference of the fixing rotation body and is also contacted the whole region contacting the toner image carried on the recording material in a width direction. Therefore, the paper dust adhering to the whole region of a circumferential surface of the fixing rotation body can be removed.

On the other hand, based on a detection result of the paper dust amount measuring section or the image amount detection section, the amount of paper dust adhering to a circumferential surface of a fixing rotation body is estimated and based on this estimated value, formation of a toner image with a low toner area coverage can also be controlled by outputting a warning to the effect that there is a possibility of causing a defect in an image or inhibiting formation of the low density toner image. That is, when the low density toner image is formed, a white portion to which a toner image is not transferred is left widely, so that toner adhering to the fixing rotation body adheres to a low density portion of a recording material and tends to cause a stain on an image. Therefore, in the case of estimating that a large amount of paper dust adheres to the fixing rotation body, a stain on an image can be prevented properly by performing control to take measures to output the warning or inhibit the image formation as described above.

Also, the image forming apparatus controlled as described above can be controlled to preferentially execute a job of forming a toner image with high toner area coverage among subsequent image formation jobs when paper dust amount estimating section estimates that the amount of paper dust is a predetermined amount or more. As a result of this, a high density toner image on a recording material is heated and pressurized in a pressure contact part of fixing section, and paper dust on a circumferential surface of a fixing rotation body can be attached to toner to be removed. In this case, since the toner area coverage of the image to be preferentially formed is high, a stain on an image, if any, can be hardly noticeable. Therefore, paper dust can be removed from the fixing rotation body without forming and fixing an image pattern with high toner area coverage for the purpose of removing the paper dust.

Also, this paper dust amount estimating section may cumulate image density differences between a high density region to which a large amount of toner is transferred and a white portion to which toner is not transferred, that is, a non-image region, based on image information and estimating the amount of paper dust by this cumulative value. That is, paper dust tends to transfer to a fixing rotation body in the non-image region and the high density region has a function of removing paper dust adhering to the fixing rotation body, so that it can be estimated that the paper dust adhering to the fixing rotation body increases when the non-image region increases as opposed to the high density region. Then, when the image density difference between these regions is compared with a preset value and reaches this preset value, control can be performed to display a warning, inhibit an output of a low density toner image or remove paper dust adhering to the fixing rotation body.

According to the above image forming apparatus, the amount of paper dust adhering to a fixing rotation body can be estimated from the amount of paper dust present on a recording material or image information of a toner image to be formed, and the image forming apparatus can be controlled so as to remove the paper dust from the fixing rotation body properly based on this estimation. Also, display of a warning, inhibition of an output of a low density image or adjustment of order of output of images formed, etc. can be performed and an offset of toner induced by paper dust can be prevented efficiently. The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image forming section which transfers toner onto a latent image due to a difference of electrostatic potential to form a toner image;

a transfer section which transfers the toner image onto a recording material directly or via an intermediate transfer body;

a fixing section which passes the recording material on which the toner image is transferred between a fixing rotation body and a pressurizing member contacted and pressed to each other, and heats and pressurizes to fix the toner image; and an image amount detection section which previously detects an amount of an image area where the toner is to be transferred to form the toner image based on input image information, wherein the image forming section forms an image pattern with high toner area coverage after a predetermined number of the toner images are transferred, the predetermined number based on the amount of the image area where the toner is to be transferred detected by the image amount detection section, and the fixing section fixes the image pattern with the high toner area coverage transferred onto a recording material, and the predetermined number of the toner image transferred before forming the image pattern with the high toner area coverage is set to a first number of sheets of paper passing through the fixing section when the amount of area where the toner is to be transferred detected by the image amount detection section is less than a threshold amount and a second number of sheets of paper passing through the fixing section when the amount of the image area where the toner is to be transferred is greater than the threshold amount, with the second number of sheets being greater than the first number of sheets.

2. The image forming apparatus according to claim 1, wherein a toner area coverage of the image pattern with the high toner area coverage is set based on the amount of the image area where the toner is to be transferred detected by the image amount detection section.

3. The image forming apparatus according to claim 1, wherein a toner coverage region of the image pattern with the high toner area coverage has a length longer than or equal to a circumferential length of the fixing rotation body in a transport direction of the recording material, and has a maximum width of a region in which the fixing rotation body and the toner image are contacted and pressurized.

* * * * *